US008555678B2

(12) United States Patent
Lee et al.

(10) Patent No.: US 8,555,678 B2
(45) Date of Patent: Oct. 15, 2013

(54) WASHING MACHINE SYSTEM AND WASHING METHOD

(75) Inventors: Jong Min Lee, Seoul (KR); Young Ho Kim, Seoul (KR); Jae Hyun Kim, Seoul (KR); Jae Won Chang, Seoul (KR); Sang Hoon Lee, Seoul (KR); Chang oh Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 894 days.

(21) Appl. No.: 12/431,511

(22) Filed: Apr. 28, 2009

(65) Prior Publication Data

US 2010/0139010 A1 Jun. 10, 2010

(30) Foreign Application Priority Data

Dec. 9, 2008 (KR) ..... 10-2008-0124850
Dec. 9, 2008 (KR) ..... 10-2008-0124851
Dec. 9, 2008 (KR) ..... 10-2008-0124852

(51) Int. Cl.
*D06F 39/02* (2006.01)

(52) U.S. Cl.
USPC ..... 68/17 R

(58) Field of Classification Search
USPC ..... 68/17 R; 222/165, 166
See application file for complete search history.

(56) References Cited

U.S. PATENT DOCUMENTS 2,562,843 A * 7/1951 Grondahl ..... 392/312
4,993,457 A 2/1991 Berfield
5,007,254 A 4/1991 Wolfe et al.
5,870,906 A 2/1999 Denisar
6,401,499 B1 6/2002 Clark et al.
2005/0034490 A1* 2/2005 Oh et al. ..... 68/5 C
2009/0090141 A1* 4/2009 Deppermann et al. ..... 68/17 R

FOREIGN PATENT DOCUMENTS

| | | | |
|---|---|---|---|
| CN | 101307556 | | 11/2008 |
| DE | 84 03 009 | | 7/1985 |
| EP | 1 995 368 | | 11/2008 |
| EP | 2 011 913 | | 1/2009 |
| GB | 2214524 A | * | 9/1989 |
| WO | WO 2008/016683 | | 2/2008 |
| WO | WO 2008/138798 | | 11/2008 |

OTHER PUBLICATIONS

Machine translation of WO 2008/138798 A2, no date.*

* cited by examiner

*Primary Examiner* — Joseph L Perrin
(74) *Attorney, Agent, or Firm* — McKenna Long & Aldridge LLP

(57) ABSTRACT

A system including an enclosure of a washing machine, a drum within the enclosure, a mixing unit, within the enclosure but separate from the drum and in fluid communication with the drum, a water supply unit coupled to the mixing unit, a reservoir having a conduit fluidly coupled to the mixing unit, and a container connecting assembly configured to fix a spout of a container to the reservoir. An apparatus including a reservoir, external to a washing machine, to receive a liquid wash aid, a container connecting assembly coupled to the reservoir and configured to fix a spout of a container containing liquid wash aid to the reservoir, a flexible conduit to pass liquid wash aid from the reservoir to the washing machine, and a wash aid control unit connected to the flexible conduit and adapted to meter a flow of liquid wash aid from the reservoir to the washing machine.

9 Claims, 17 Drawing Sheets

WASHING MACHINE SYSTEM AND WASHING METHOD

This application claims the benefit of Korean Patent Application Nos. 10-2008-0124850, 10-2008-0124851, and 10-2008-0124852, all filed in the Republic of Korea on Dec. 9, 2008, the entireties of each are hereby incorporated by reference for all purposes as if fully set forth herein.

BACKGROUND OF THE INVENTION

1. Field of the Invention

The present invention relates to a washing machine and, more particularly, to a washing machine, to which liquid wash aid is automatically supplied.

2. Discussion of the Related Art

In general, a washing machine is a machine that removes contaminants (e.g., dirt) from clothes, beddings and the like (hereinafter referred to as "laundry") through washing, rinsing, and dehydrating cycles using water, wash aid(s), and mechanical operations.

The washing machine generally includes a washing tub accommodating water and laundry and rotatably disposed in a drum. As the washing tub is rotated by a driving unit, the laundry is washed. In further detail, a water supply unit may be configured to supply water to the washing tub and a water discharge unit may be configured to discharge water from the drum to the outside. Both the water supply and water discharge units are provided within the washing machine. A wash aid supply unit, configured to supplying wash aid to the inside of the washing tub, is disposed at a water supply passage (e.g., a water supply channel or a water supply line) of the water supply unit. The wash aid supply unit includes a dispenser disposed to be connected to the water supply passage and a wash aid box receiving various wash aids and disposed to be inserted into or withdrawn from the dispenser.

Thus, in the washing machine according to the related art, the wash aid box is withdrawn from the dispenser, powder or liquid wash aid is put into the wash aid box, and then the wash aid box containing the wash aid is re-inserted into the dispenser. At this time, if the water supply unit is operated, the powder or liquid wash aid in the wash aid box is supplied to the inside of the washing tub by water flowing through the water supply passage of the water supply unit, through the wash aid box, and into the dispenser, where it is drained into the tub Because a user puts wash aid(s) directly into the wash aid box of the washing machine according to the related art, the operation of putting the wash aid into the wash aid box is repeatedly performed every time the washing machine is used to wash laundry, thus degrading the convenience to the user of use of the washing machine. Moreover, because the amount of wash aid(s) put into the wash aid box is typically determined based on the user's intuition, there are problems in that the amount wash aid put into the wash aid box is too large or too small, and thus the wash aid is wasted or the washing performance is deteriorated, respectively. Additionally, a new style of wash aid container for liquid wash aid and has been recently introduced and put on sale in the market. The new style of wash aid container is provided with a valve operated by a depressing a mechanical button. Wash aid from the container flows from a spout on the container when the button is depressed. However, as in the past, the wash aid container is not connected to the washing machine. Thus, a user is required to transfer liquid wash aid from the new style of wash aid container to an intermediate container, such as a measuring cup, before transferring the liquid wash aid into the wash aid box of the washing machine. This is quite inconvenient to the user. It is likewise inconvenient for the user to hold the new style of wash aid container over the wash aid box to fill the wash aid box. The containers are heavy and both hands may be required to suspend the container over the wash aid box and depress the mechanical button causing the liquid wash aid to flow from the wash aid container's spout into the wash aid box.

SUMMARY OF THE INVENTION

It is, therefore, a feature of the present invention to provide a washing machine, to which an appropriate amount of liquid wash aid is automatically supplied.

It is another feature of the present invention to provide a washing machine, on which a liquid wash aid container, containing liquid wash aid is seated.

It is still another feature of the present invention to provide a washing machine, to which liquid wash aid is automatically supplied using a commercially available liquid wash aid container as-is, without a need for modification of the container.

Additional features and advantages of the invention will be set forth in the description which follows, and in part will be apparent to those having ordinary skill in the art upon examination of the following or may be learned from a practice of the invention. The objectives and other advantages of the invention will be realized and attained by the subject matter particularly pointed out in the specification and claims hereof as well as in the appended drawings.

To achieve these objects and other advantages in accordance with the present invention, as embodied and broadly described herein, there is provided a system in accordance with an aspect of the present invention, which comprises an enclosure forming the appearance of a washing machine, a drum housed within the enclosure, a mixing unit, housed within the enclosure but separate from the drum and in fluid communication with the drum, a water supply unit coupled to the mixing unit, a reservoir having a conduit configured to fluidly couple the reservoir to the mixing unit, and a container connecting assembly configured to fix a spout of a container to the reservoir.

There is additionally provided an apparatus in accordance with an aspect of the present invention, which comprises a reservoir, external to a washing machine, to receive a liquid wash aid, a container connecting assembly coupled to the reservoir and configured to fix a spout of a container containing the liquid wash aid to the reservoir; a flexible conduit to pass the liquid wash aid from the reservoir to the washing machine, and a wash aid control unit connected to the flexible conduit and adapted to meter a flow of the liquid wash aid from the reservoir to the washing machine.

There is additionally provided a washing method including the steps of first fixing a spout of a container containing a liquid wash aid to a wash aid inlet and, by the act of fixing, opening a valve of the container and maintaining the valve of the container in a open state to permit an unimpeded flow of the liquid wash aid into a reservoir, next opening a valve to allow water to flow into a mixing unit and dispensing a metered amount of the liquid wash aid into the mixing unit, while passing the water and metered amount of liquid wash aid into a drum of a washing machine, and finally operating the washing machine according to a program stored in a memory of the washing machine.

It is to be understood that both the foregoing explanation and the following detailed description of the present invention are exemplary and illustrative and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention.

DETAILED DESCRIPTION OF THE EMBODIMENTS

Reference will now be made in detail to the preferred embodiments of the present invention, examples of which are illustrated in the accompanying drawings. Like numerals are used to indicate like elements throughout the specification and drawings.

Figure 1:
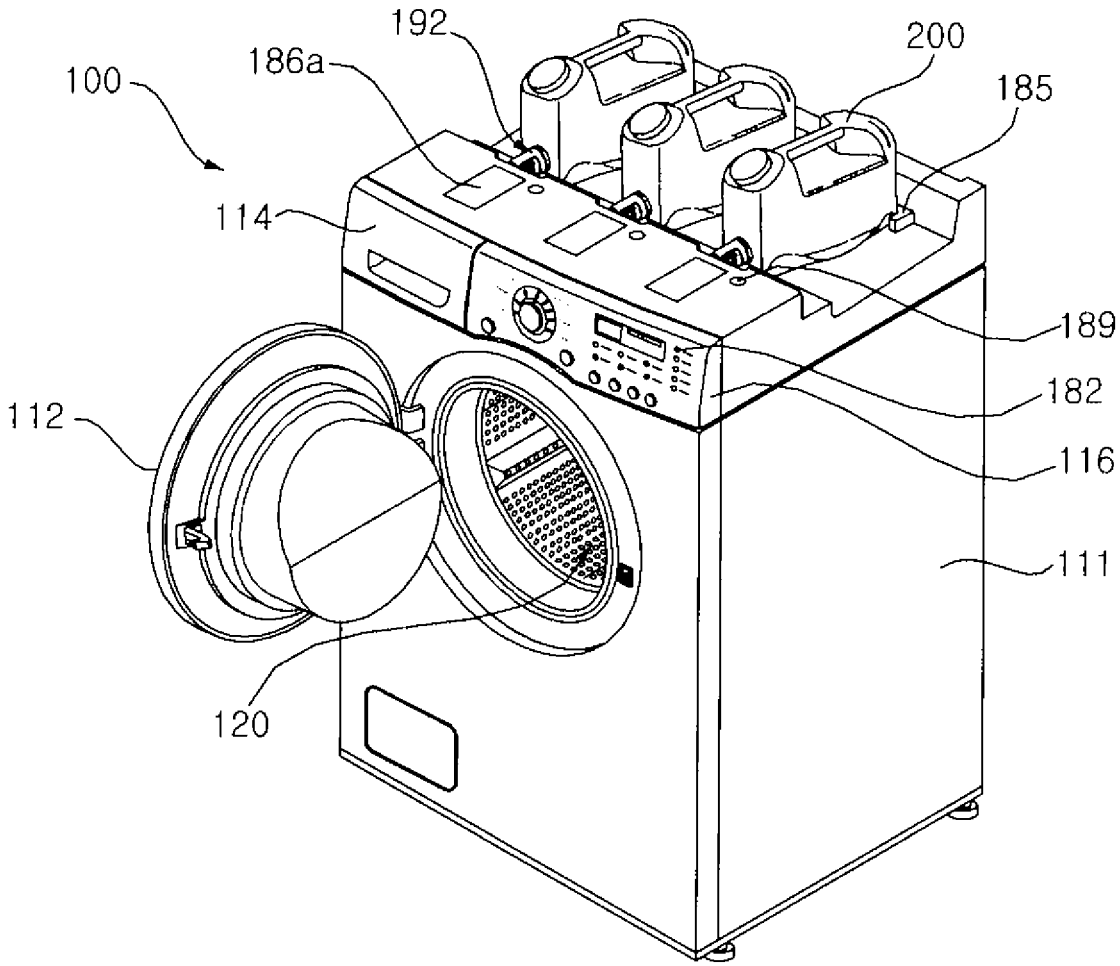
FIG. 1 is a perspective view of a washing machine in accordance with a first embodiment of the invention.
Figure 3:
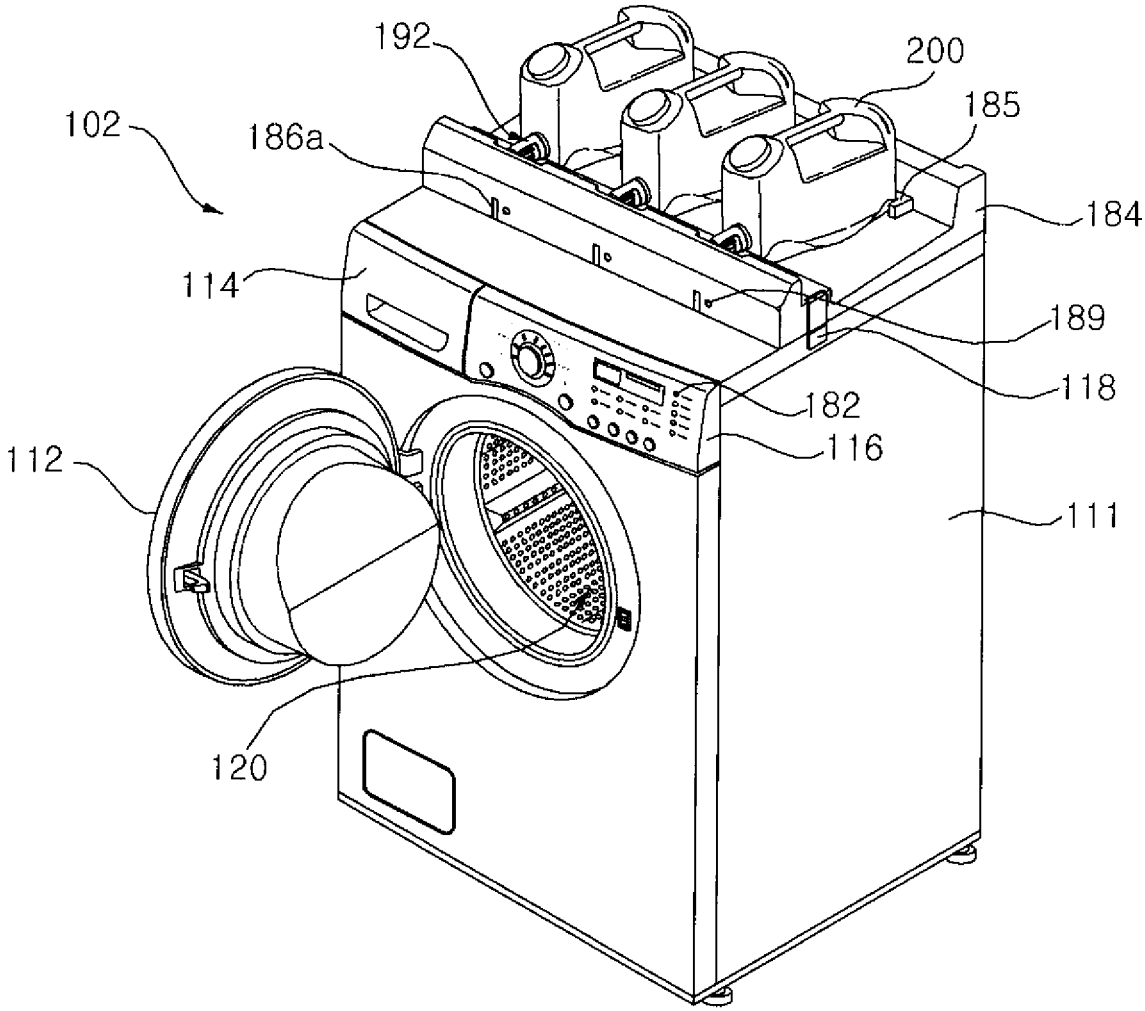
FIG. 3 is a perspective view of a washing machine in accordance with a second embodiment of the invention.
Figure 7:
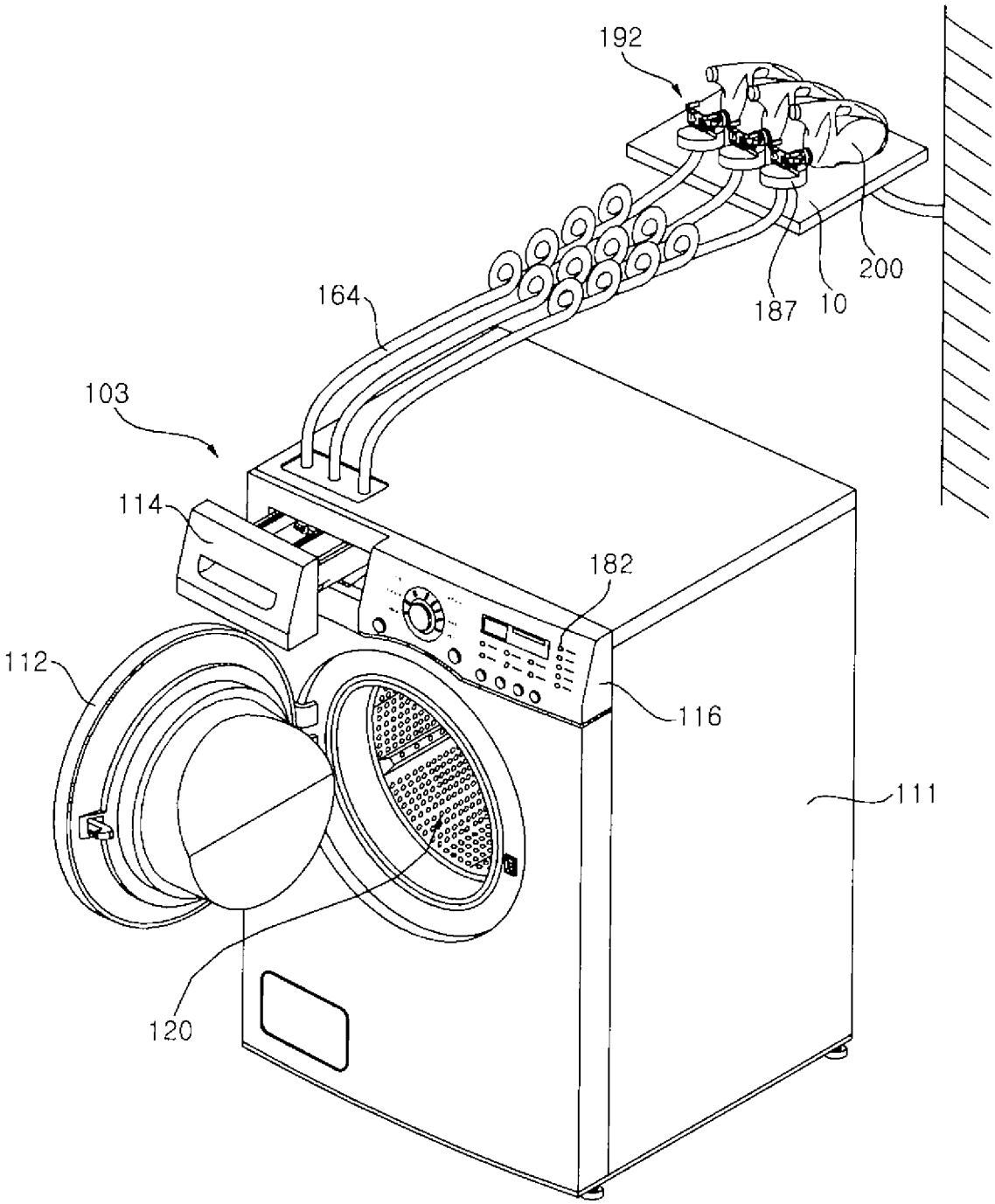
FIG. 7 is a perspective view of a washing machine in accordance with a third embodiment of the invention.

FIG. 1 is a perspective view of a washing machine 100 in accordance with a first embodiment of the present invention. FIG. 3 is a perspective view of a washing machine 102 in accordance with a second embodiment of the present invention. FIG. 7 is a perspective view of a washing machine 103 in accordance with a third embodiment of the present invention.

The washing machine 100, 102, 103 in accordance with the several embodiments of the present invention includes an enclosure, which may also be referred to as a main body 111, forming an external appearance of the washing machine 100, 102, 103, a door 112 configured to allow laundry to be put into the main body 111 by opening and closing one side of the main body 111, a washing tub 120 disposed within the main body 111 to receive laundry for washing, a control panel 116 for user interface, and a processor (105 of FIGS. 2, 4, 8) for executing instructions causing the washing machine to perform steps of methods related to washing operations.

The washing machine 100, 102, 103 may include a wash aid box 114. The wash aid box 114 may be slidingly engaged within a dispenser in the main body 111 or fixed within the main body 111. In some embodiments, the wash aid box 114 may be removable by a user while in other embodiments, the wash aid box 114 may not be removable by the user.

In the embodiment of FIG. 1, the washing machine 100 may receive a detachable wash aid container 200 on a top surface of the main body 111. In the embodiment of FIG. 3, the washing machine 102 may receive a detachable liquid wash aid module 184 on a top surface of the main body 111. The liquid wash aid module 184 may receive a detachable wash aid container 200 on a top surface thereof. In the embodiment of FIG. 7, a wash aid container 200 may be placed on a surface near the washing machine, such as a shelf above the washing machine. Of course, nothing would prevent the wash aid container 200 from being placed on the top surface of the main body 111 of the washing machine 103 itself.

Figure 2:
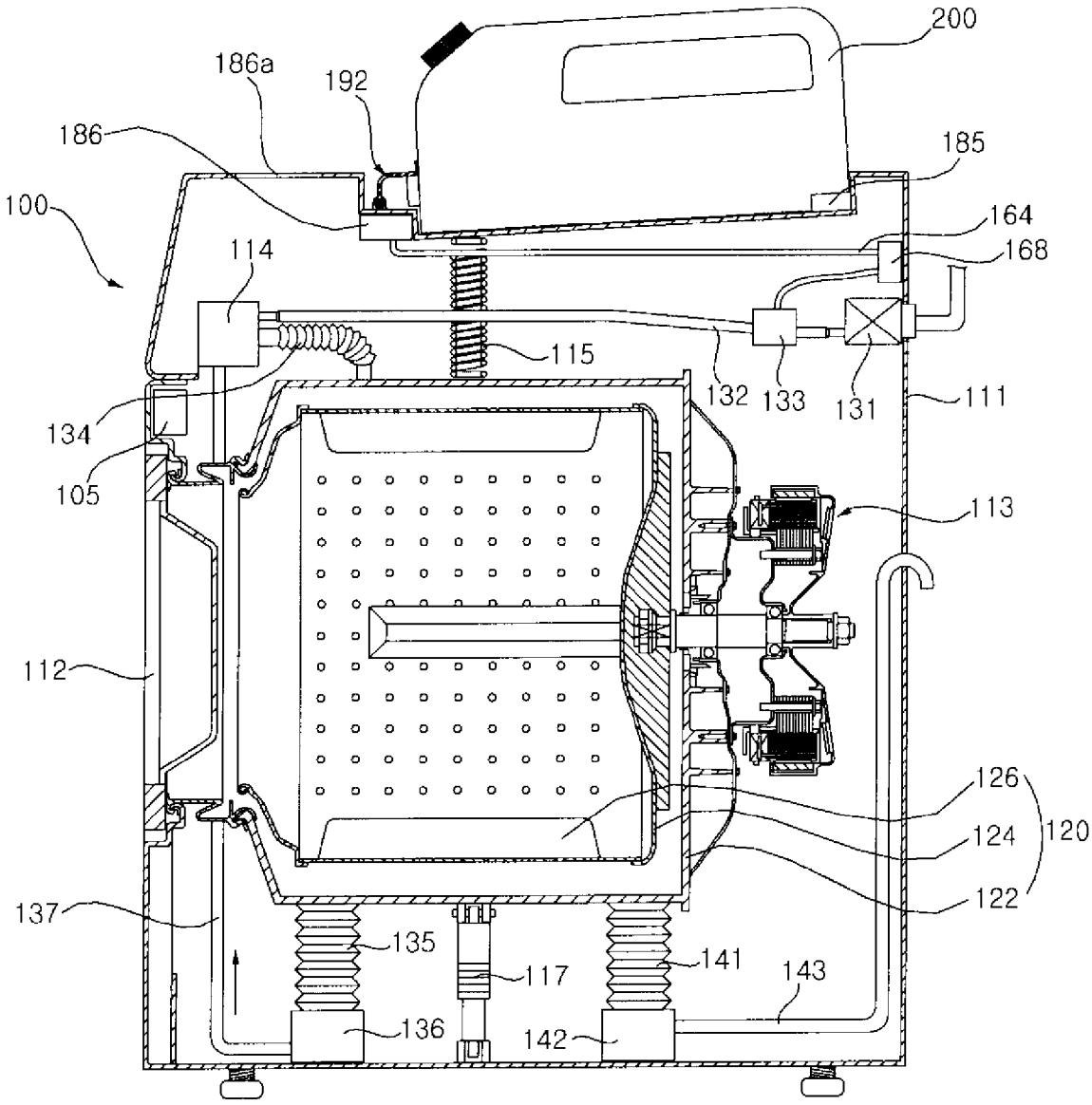
FIG. 2 is a side cross-sectional view of the washing machine in accordance with the embodiment of FIG. 1.
Figure 4:
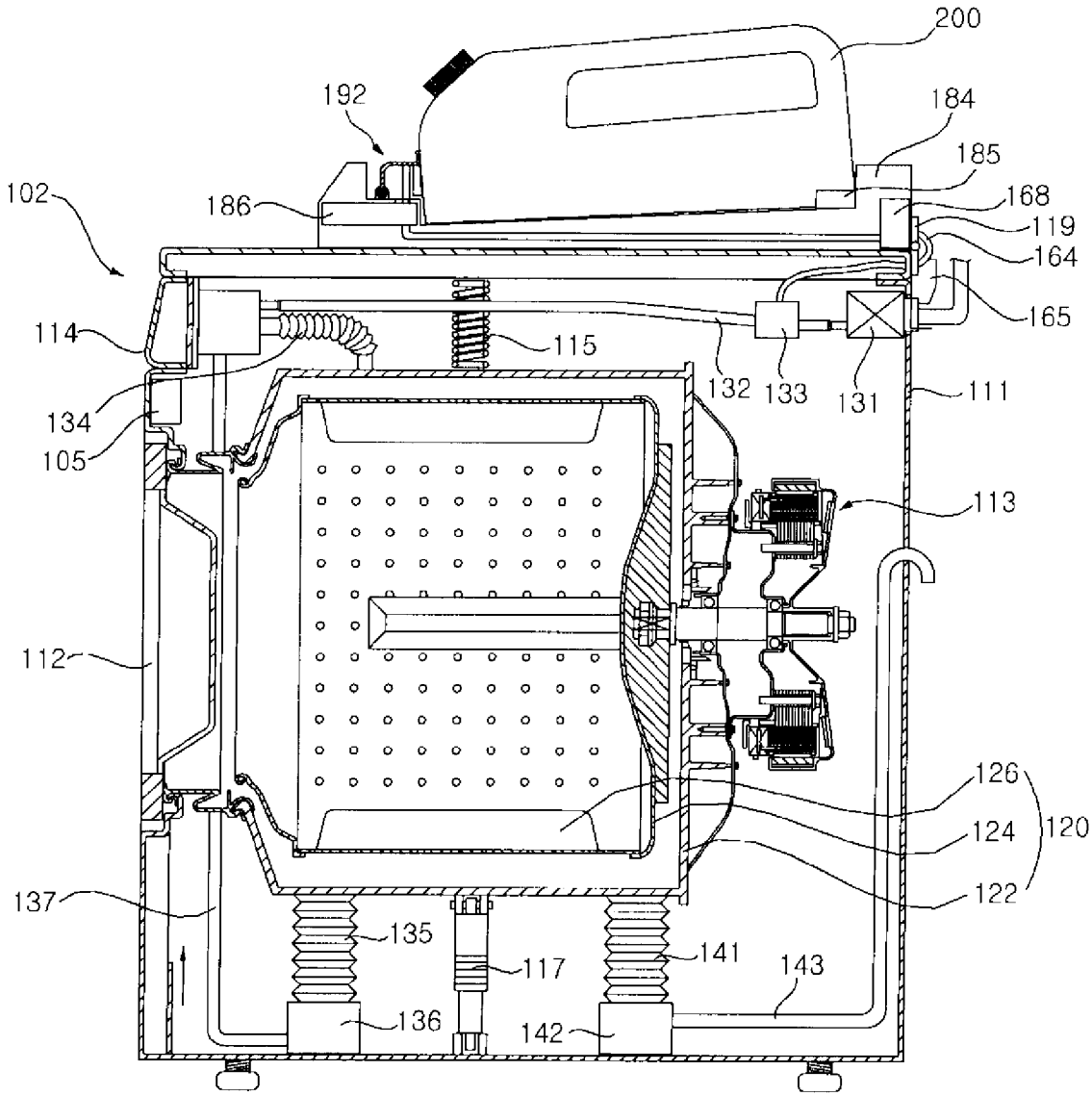
FIG. 4 is a side cross-sectional view of the washing machine in accordance with the embodiment of FIG. 3.
Figure 8:
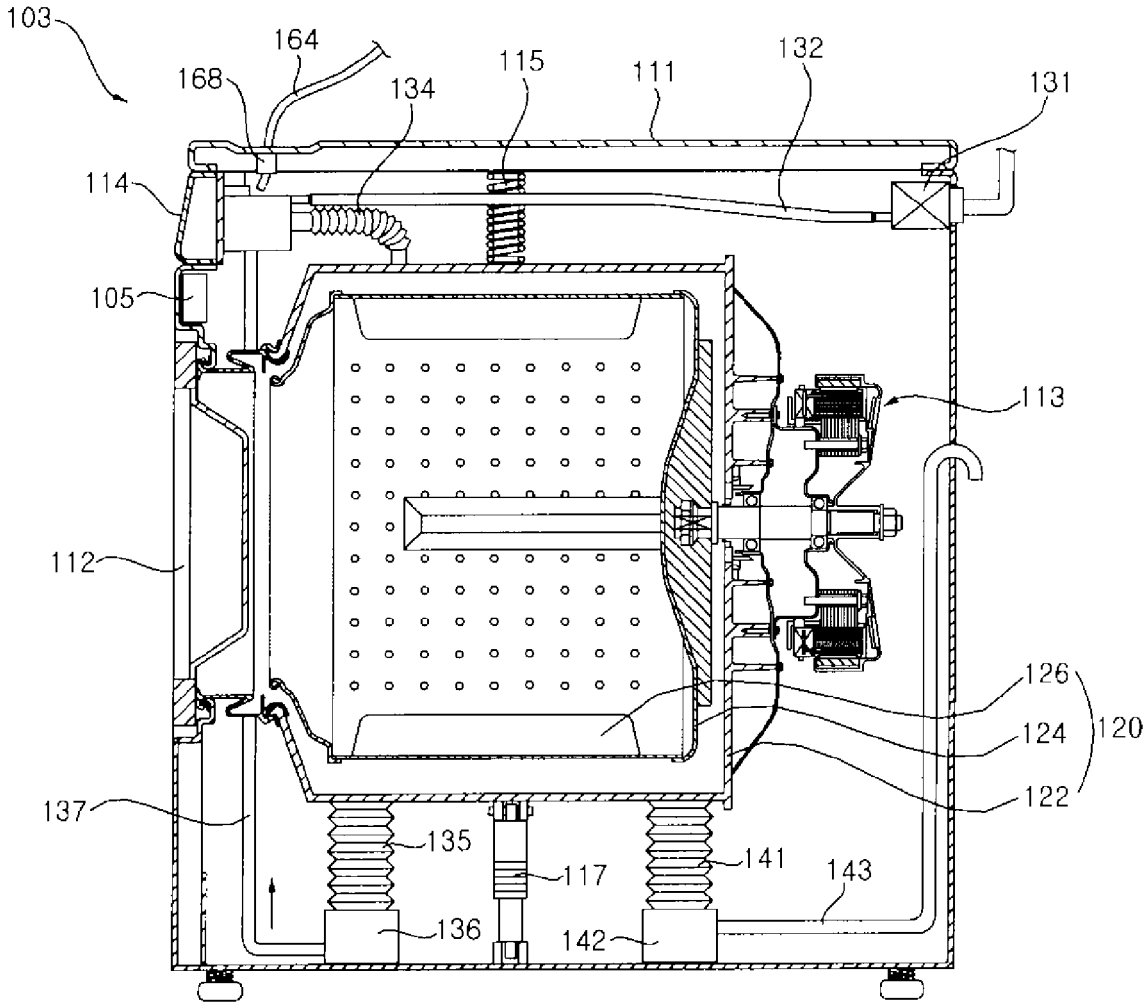
FIG. 8 is a side cross-sectional view of the washing machine in accordance with the embodiment of FIG. 7.

FIG. 2 is a side cross-sectional view of the washing machine in accordance with the embodiment of FIG. 1. FIG. 4 is a side cross-sectional view of the washing machine in accordance with the embodiment of FIG. 3. FIG. 8 is a side cross-sectional view of the washing machine in accordance with the embodiment of FIG. 7.

In each of the various embodiments, the washing tub 120 accommodates laundry, liquid wash aid, and wash water during washing. The washing tub may be disposed within the main body 111 so as to be buffered by a spring 114 and a damper 117. The washing tub 120 preferably includes a drum 122 configured to contain wash water and wash aid, a tub 124 rotatably disposed within the drum 122, accommodating laundry, and having a plurality of holes, through which the wash water and wash aid in the drum 122 are free to pass through, and a lifter 126 disposed on an inner surface of the tub 124 to lift the laundry to a predetermined height during rotation of the tub 124 and then drop the same. The tub 124 may be rotated by a rotational force of a driving unit 113 coupled thereto and provided inside the main body 111.

A water supply valve 131 through which wash water may be introduced from an external water source, a first water supply passage 132, the wash aid box 114, which may be disposed in a dispenser (not shown), and a second water supply passage 134 through which the wash water and wash aid are introduced into the drum 122 and tub 124 are provided in the main body 111.

In the embodiments of FIGS. 2 and 4, a mixing unit 133 may be provided between the water supply valve 131 and the first water supply passage 132. In such a configuration, the wash water introduced through the water supply valve 131 may be mixed with liquid wash aid from the wash aid container 200 in the mixing unit 133 prior to the passage of the combined wash water and liquid wash aid through the first water supply passage 132. Of course, the liquid wash aid from the wash aid container 200 could be directed to the wash aid box 114 without use of a separate mixing unit 133 as illustrated in the embodiment of FIG. 7. In the embodiment of FIG. 7, and as illustrated in the configuration of FIG. 8, the wash water introduced through the water supply valve 131 may be mixed with liquid wash aid from the wash aid container 200 in the wash aid box 114.

In the embodiments of FIGS. 2, 4, and 8, a circulation bellows 135 through which the wash water and liquid wash aid in the drum 122 are circulated, a circulation pump 136 configured to moving the wash water and liquid wash aid, and a circulation passage 137 through which the wash water and liquid wash aid flows may be provided in the main body 111. Water circulates in the direction of the arrow, as shown in the circulation passage 137.

Furthermore, a discharge bellows 141 through which the wash water and liquid wash aid in the drum 122 are discharged, a discharge pump 142 configured to discharging the wash water and liquid wash aid, and a discharge passage 143 through which the wash water and liquid wash aid are discharged to the outside are also preferably provided in the main body 111.

The internal structure and layout of the above-described washing machines 100, 102, 103, including the washing tub 120 and main body 111, may be modified by those skilled in the art.

The various embodiments may further comprise a flexible conduit 164 that may fluidly couple wash aid from the wash aid container 200 to the wash aid box 114. By way of example, the flexible conduit 164 may comprise flexible and/or rigid or semi-rigid tubing. The various embodiments may further comprise a wash aid control unit 168 configured to control and/or meter the flow of the liquid wash aid passing from the wash aid container 200 to the wash aid box 114.

The wash aid container 200 may be a commercially available container and may be used as-is, without modification. Alternatively, the liquid wash aid may be stored in a container adapted for such a purpose for the washing machine.

Returning to FIGS. 1 and 3, the top surfaces of the washing machine 100 and the wash aid supply module 184, respectively, may be formed to stably receive a wash aid container 200. The top surfaces may include a wash aid container fixing unit 185 for fixing the wash aid container 200 to the washing machine 100 or the wash aid supply module 184, respectively. The wash aid container fixing unit 185 may be formed in various shapes according to the shape of the wash aid container 200 and may, for example, fix one or more sides, including the bottom, of the wash aid container 200 to the washing machine 100 or the wash aid supply module 184, respectively.

The top surfaces of the washing machine 100 and the wash aid supply module 184, respectively, may be formed to accommodate a plurality of wash aid containers 200. The plurality of containers may have different shapes. In one embodiment, the plurality of wash aid containers 200 may individually contain a washing detergent, a cleaning detergent (e.g., fabric softener), and a bleaching liquid, respectively. Moreover, portions of the top surfaces of the washing machine 100 and the wash aid supply module 184 may be formed to match the shape of portions of one or more surfaces of the wash aid container 200. In one embodiment, a depression corresponding to an outer shape of a portion of a wash aid container 200 may be formed in the top surface in order to receive the wash aid container 200. In one embodiment, portions of the top surfaces of the washing machine 100 and wash aid supply module 184 may be formed of an elastic member capable of matching with or conforming to the shape of a wash aid container 200 placed thereon.

Other ways to stably support and/or fix a wash aid container 200 on a top surface of a washing machine 100, or on a wash aid supply module 184, are within the scope of the invention.

Figure 5:
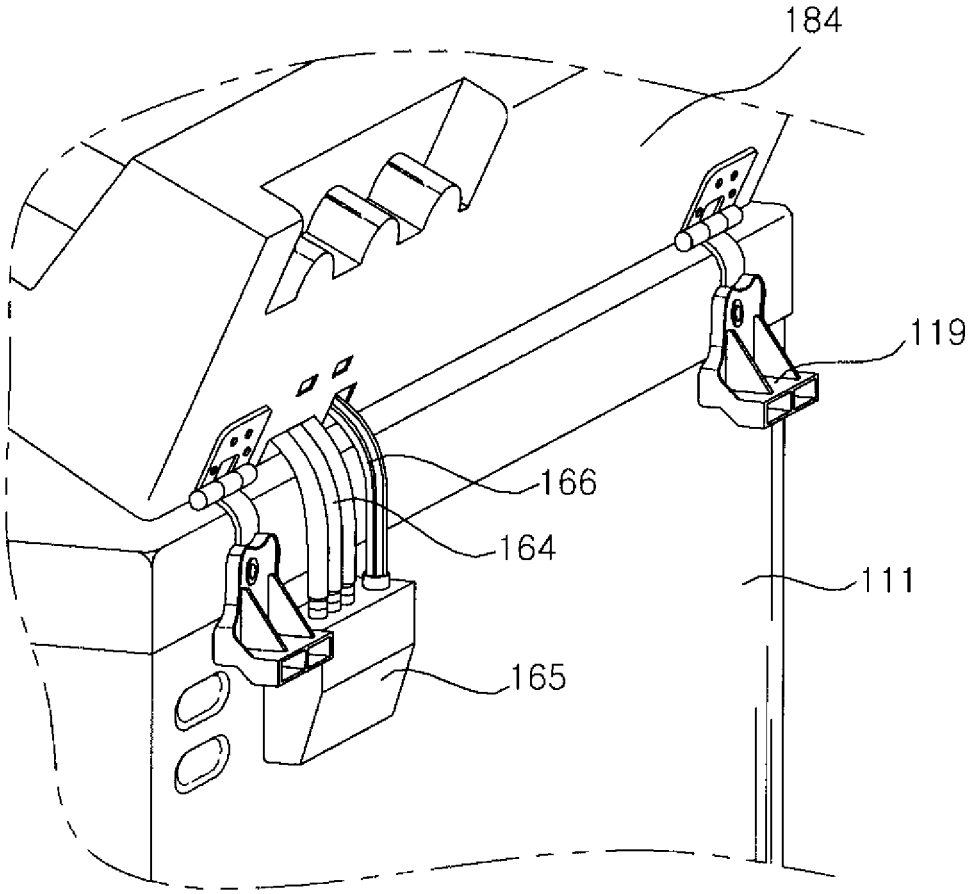
FIG. 5 of is a rear perspective view of the washing machine in accordance with the embodiment of FIG. 3, illustrating a wash aid supply module in a partially raised state.

As illustrated in FIGS. 4 and 5, the flexible conduit 164 may extend out from the rear of the wash aid supply module 184 and connect to an interface 165 on the rear of the main body 111. The interface 165 may allow a user to conveniently connect or disconnect the flexible conduit 164 to or from the washing machine 102. The interface 165 may also receive an electrical connection 166 that may carry power and/or control signal(s) to electrically operated components of the wash aid supply module 184. The electrical connection may couple, for example, the processor 105 to these electrically operated components of the wash aid supply module 184.

In the embodiment of FIG. 7, the flexible conduit 164 may extend from one or more wash aid containers 200 placed on, for example, a shelf 10 on a wall near washing machine 103, to the washing machine 103. The flexible conduits 164 may be coupled to the main body 111 of washing machine 103 via mechanical couplings or even via through-holes in the upper surface 350 (FIG. 9) of the washing machine 103.

Figure 9:
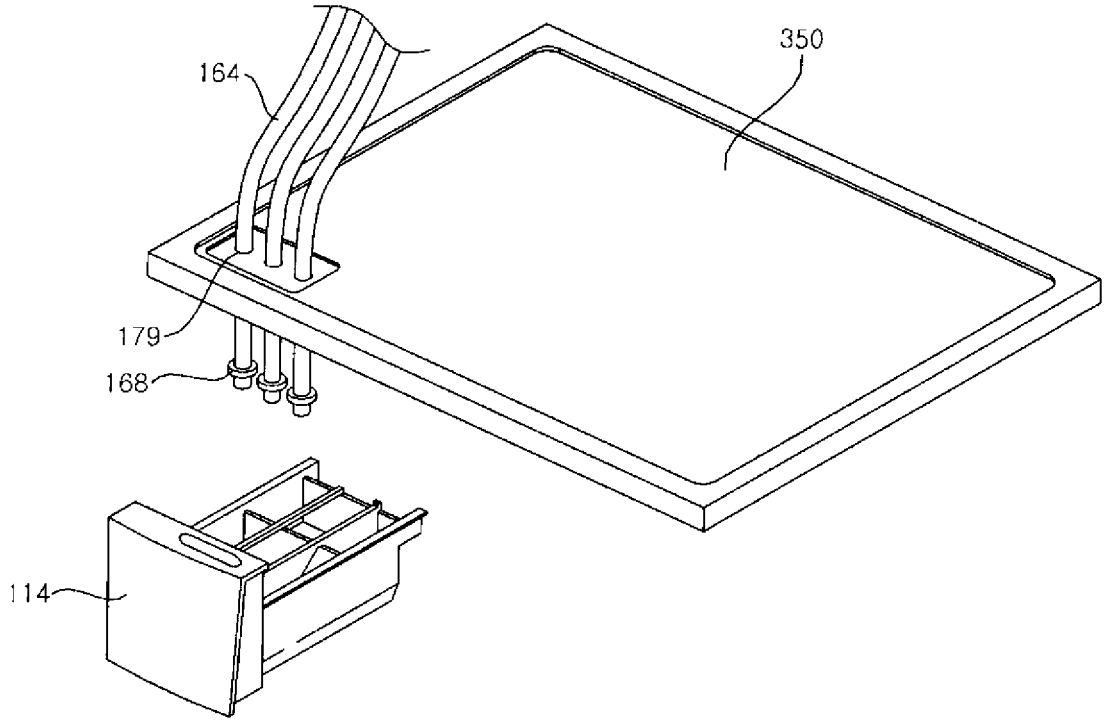
FIG. 9 is an exploded perspective view of a portion of a washing machine in accordance with the embodiment of FIG. 7.

In the embodiment of FIGS. 7 and 9, a plurality of flexible conduits 164 are disposed to pass through through-holes 179 formed through an upper surface 350 of the main body 111 of the washing machine 103. A wash aid control unit 168 may be disposed at an end of each of the flexible conduits 164. In the example shown, the wash aid control unit 168 are disposed at the ends of the flexible conduits 164 on the inside of the main body 111. Various placements of wash aid control units 168 and coupling methods of wash aid control units 168 to flexible conduits 164 and/or the main body 111 may be selected by those of skill in the art without departing from the scope of the invention.

With reference to FIG. 9, three flexible conduits 164 are illustrated. These may be coupled to individual compartments in the wash aid box 114. As shown, each flexible conduit 164 may include a wash aid control unit 168 to control the flow of the wash aid that passes through the flexible conduit 164. The wash aid control unit 168 may be implemented as a tube-pump or some other type of pump or a valve. In one embodiment, a peristaltic pump, a class of tube-pump, is used. The wash aid control unit 168 may regulate the amount of wash aid discharged from an associated wash aid container 200, such that the amount of wash aid identified by an instruction executed by the processor 105 is delivered to the wash aid box 114. The wash aid control unit 168 may be controlled automatically via an interface to the processor 105. In some embodiments, the wash aid control unit 168 may be controlled by a user from the control panel 116.

The wash aid discharged from the flexible conduit 164 may be supplied to the wash aid box 114. The wash aid box 114 may be partitioned into compartments to accommodate different types of wash aids, such as washing liquid detergent, rinsing liquid detergent (e.g., fabric softener), and bleaching liquid.

The wash aid delivered to the wash aid box 114 may be mixed with washing water as described above, and then introduced into the tub 122 through the second water supply passage 134.

In the embodiment of FIG. 7, the flexible conduits 164 may be adjusted in length such that the length of the flexible conduits 164 correspond to the distances separating the wash aid containers 200, for example, from the through holes 179 in the washing machine 103. The flexible conduit 164 may be formed of a material having a shape memory, such that when it is released from being stretched it will spring back to its original or near to its original form. As shown in the embodiment of FIG. 7, the flexible conduits 164 may be formed in a coil so as to allow for extension or retraction without excess flexible conduit 164 left lying about. Such a configuration may allow for self-adjustment of length and may be convenient for adapting to different distances between the washing machine 103 and the remotely placed wash aid containers 200. Of course flexible conduits 164 may be implemented in a variety of ways, such as winding the flexible conduits on a roller or the like, without being limited thereto.

Figure 6:
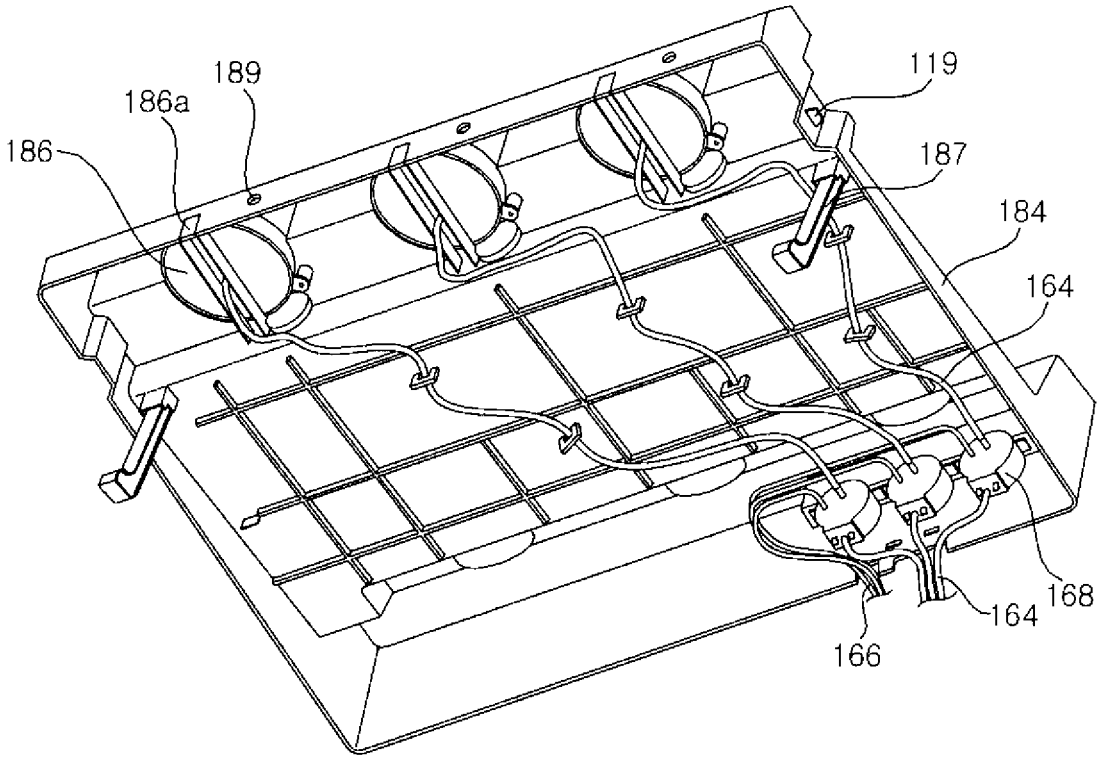
FIG. 6 is a bottom perspective view of the wash aid supply module in accordance with the embodiment of FIG. 3.

Turning now to FIGS. 5 and 6, the wash aid supply module 184 may be provided outside the main body 111 of the washing machine 102. FIG. 5 is a rear perspective view of the washing machine 102 in accordance with the embodiment of FIG. 3. FIG. 5 illustrates the wash aid supply module 184 in a partially raised state. The wash aid supply module 184 may be connected to the top rear surface of the main body 111 by a hinge 119. The rear surface of the wash aid supply module 184 may be detachably connected to the main body 111 of the machine 103 via the hinge 119. The wash aid supply module 184 may be tilted with respect to the main body 111 by the hinge 119.

FIG. 6 is a bottom perspective view of the wash aid supply module 184 in accordance with the embodiment of FIG. 3. A support unit 187 may be included in the wash aid supply module 184. The support unit 187 may be rotatably coupled to the wash aid supply module 184. The support unit 187 may be configured to support the wash aid supply module 184 in a partially raised state, spaced apart at an angle from the main body 111 of washing machine 102. In this state, a user may gain access to components on the underside of the wash aid supply module. Access may be needed, for example, to allow for cleaning of certain components, such as reservoir 186. Access to reservoir 186 may provide beneficial convenience to a user in that the reservoir 186 may require cleaning. Access may be especially desired if the reservoir 186 is made, in total or in part, from transparent material. If made from transparent material, the reservoir 186 may require cleaning so as not to lose its transparency. Having the wash aid supply module 184 adapted to tilt upward at some angle, and maintain the separation between the wash aid supply module 184 and the top surface of the washing machine 102, will allow a user to gain access to the reservoir 186. Access may be required to remove the reservoir 186 from the wash aid supply module 184 for cleaning or replacement. Other mechanisms of supporting the supply module 184 in an open or tilted state are within the scope of the invention. For example, the hinge 119 may be designed to hold the supply module 184 in a tilted state without a need for support unit 187.

Figure 11:
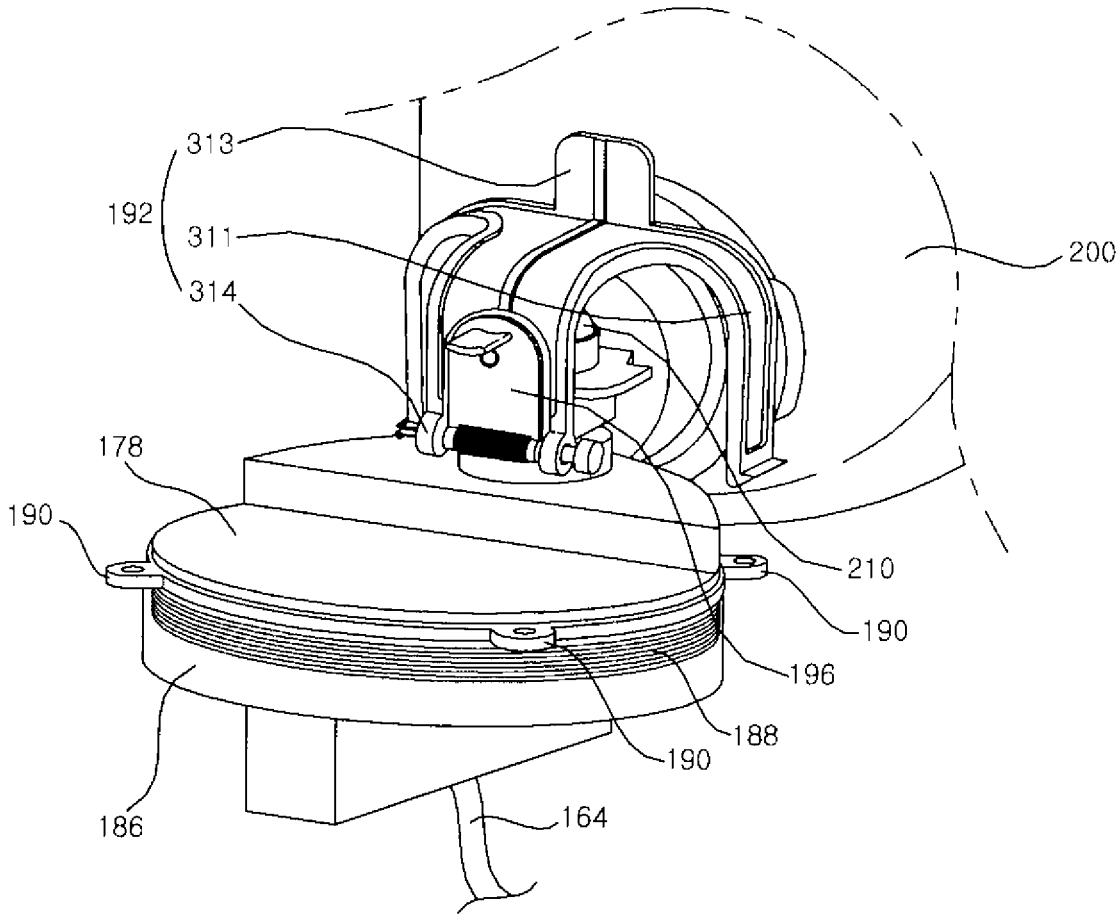
FIG. 11 is a perspective view of a reservoir coupled to a liquid wash aid supply container in accordance with the embodiments of either FIG. 1 or FIG. 3.

FIG. 11 is a perspective view of a reservoir 186 coupled to a liquid wash aid supply container in accordance with the embodiments of either FIG. 1 or FIG. 3. In the embodiment of FIG. 11, the reservoir 186 includes a cylindrical portion that includes a threaded interior portion 188. The threaded interior portion 188 mates with a threaded exterior portion of a corresponding cylindrical body extending downward from an underside of the wash aid supply module 184. A user may unscrew the reservoir 186 from the underside of the wash aid supply module 184, to detach the reservoir 186 therefrom. as shown, the flexible conduit 164 may couple to the bottom of the reservoir 186.

FIG. 6 illustrates the placement of three reservoirs 186 on the underside of the wash aid supply module 184. Similar to the embodiment illustrated in FIG. 11, the reservoirs 186 of FIG. 6 may also be detached from the wash aid supply module 184 by rotating the body of the reservoir 186 to unscrew it from the wash aid supply module 184.

When in a closed position, the wash aid supply module 184 may include a tab 119 (FIG. 6) to engage a latch 118 (FIG. 3) and thereby enable the wash aid supply module 184 to be secured to the main body 111 of washing machine 102. Alternatively, the main body 111 of washing machine 102 may include a tab (similar to 119) or slot (not shown) to engage a latch or other mechanism (similar to 118) on the wash aid supply module 184 and thereby secure the wash aid supply module 184 to the main body 111 of washing machine 102. The incorporation of various features to secure the wash aid supply module 184 to the washing machine 102 may be know to those of skill in the art and are within the scope of the invention.

As illustrated in FIG. 2, and as likewise illustrated in FIGS. 4 and 6, a washing machine 100, 102 may include a reservoir 186. In the embodiment of FIG. 2, the reservoir 186 may be located in the main body 111. In the embodiment of FIGS. 4 and 6, and as just mentioned above, reservoir 186 may be included on an underside of the wash aid supply module 184. In the embodiment of FIG. 6, the reservoir 186 may be located toward a front of the wash aid supply module 184. In both embodiments, the reservoir 186 may be detachably coupled to allow, for example, for removal, cleaning, and replacement. In the alternate embodiment of FIG. 7, the reservoir 187 (similar to 186) may be located remotely from the washing machine 103.

The reservoir 186 used in the embodiments of FIGS. 1 and 3 are similar to the reservoir 187 used in the embodiment of FIG. 7. Reservoirs 186, 187 may be configured to temporarily store liquid wash aid drawn from the wash aid container 200. In one embodiment, the reservoir 186, 187 temporarily stores at least an amount of liquid wash aid required to perform a washing operation at least once, even if the liquid wash aid in the wash aid container 200 is exhausted (e.g., the wash aid container 200 has just emptied).

Preferably, a plurality of reservoirs 186, 187 are provided. Most preferably, at least one reservoir 186, 187 is provided for each wash aid container 200. In each of the exemplary embodiments described herein, three reservoirs 186, 187 are provided.

The reservoir 186, 187 may be formed of a transparent material so that the residual amount of wash aid stored in the reservoir 186 may be viewed by a user. Viewing may be aided by viewing ports 186*a* on the washing machine 100 according to the first embodiment, and on the wash aid supply module 184 of washing machine 102 according to the second embodiment.

If a wash aid reservoir 186, 187 is not made of a transparent material overall, it may include a display window made of a transparent material to show (indicate) the remaining amount of the wash aid in the wash aid reservoir 186, 187.

The reservoir 186, 187 may include a viewing port 186*a* to allow for observation of the amount of liquid wash aid introduced from the wash aid container 200. The viewing port 186*a* may be implemented by a transparent material to permit observation of the remaining amount of the wash aid. Additionally or alternatively, a function of determining the remaining amount of wash aid may be implemented by a device 1720 (FIG. 17) capable of detecting the amount of liquid in the reservoir 186, 187 such as an electronic sensor, an electrode sensor, a magnetic sensor, a floating device, etc.

As illustrated in the embodiments of FIGS. 2, 4, 6, and 8, a wash aid control unit 168 may be provided in series with the flexible conduit 164. The wash aid control unit 168 may act to control, or meter, the flow of the liquid wash aid passing through the flexible conduit 164. The wash aid control unit 168 may be implemented by a valve, and preferably by a pump capable of moving the liquid wash aid through the flexible conduit 164. In one embodiment, the wash aid control unit 168 may be a tube pump, also known as a peristaltic pump. In one embodiment the pump may be configured so as not to need any priming. Alternatively, the wash aid control unit 168 may be implemented by a pump configured to positively or negatively pressurize the liquid wash aid in the flexible conduit 164. The wash aid control unit 168 may be controlled by the controller 105. When operated by the controller 105, the wash aid control unit 168 may be configured to control the amount of liquid wash aid supplied to the washing tub 120 according to, for example, the amount of laundry and water in the washing tub 120, and a predetermined washing course that may be selected by a user.

In the embodiment of FIG. 2, the wash aid control unit 168 may be provided on a rear inside surface of the main body 111. The flexible conduit 164 may be connected at one end to the wash aid control unit 168 and at the other end to the reservoir 186. In the embodiment of FIG. 4, the wash aid control unit 168 may be provided on the rear inside surface of the wash aid supply module 184. Similar to the embodiment of FIG. 2, the flexible conduit 164 may be connected at one end to the wash aid control unit 168 and at the other end to the reservoir 186. In the embodiment of FIG. 8, the wash aid control unit 168 may be provided at a far end of the flexible conduit 164 and may be positioned above the wash aid box 114, as illustrated in FIGS. 8 and 9. Alternate placements of the wash aid control unit 168 in each of the various embodiments are within the scope of the invention.

Figure 10:
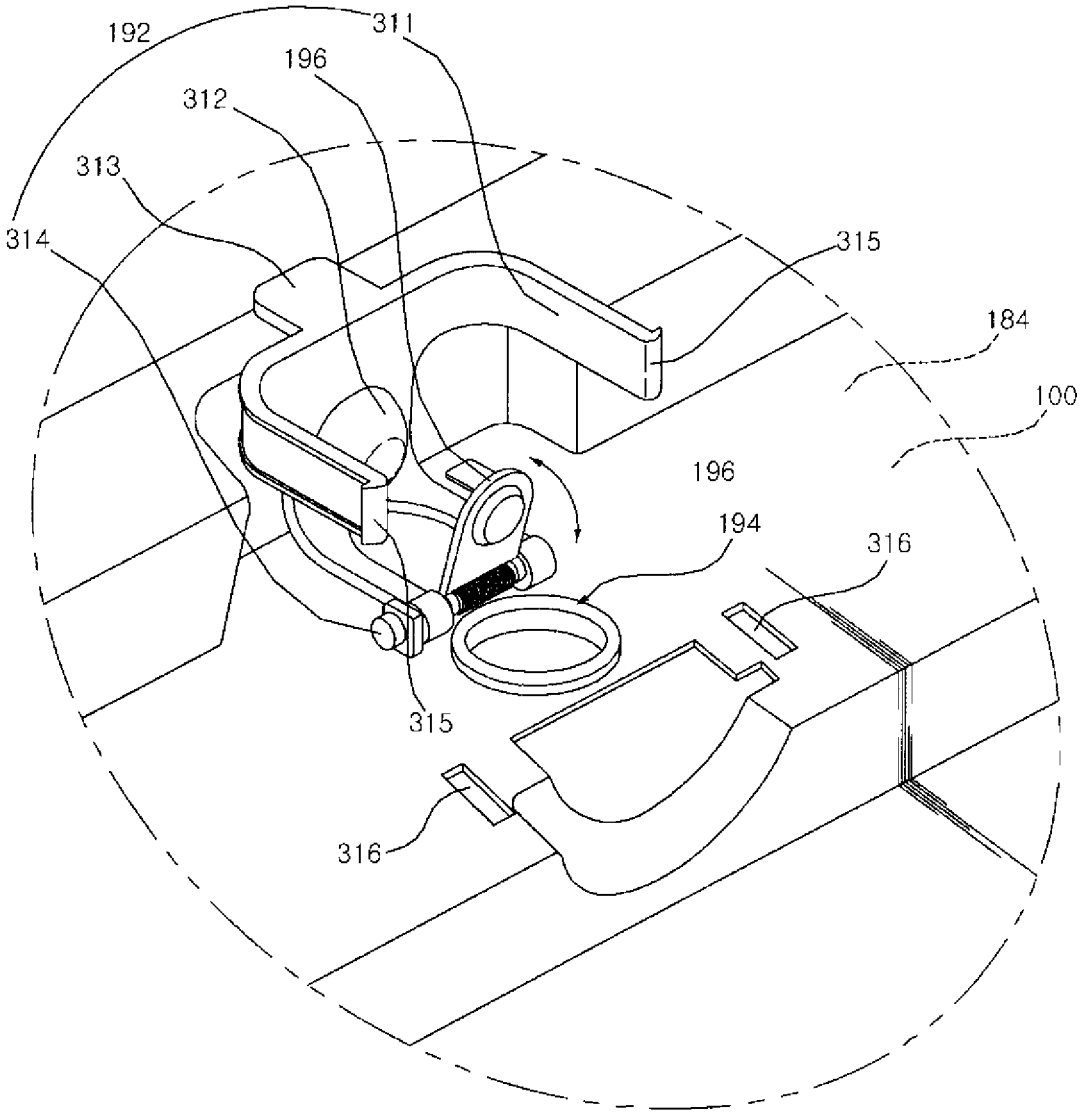
FIG. 10 is a perspective view of a portion of an upper surface of a washing machine according to the embodiment of FIG. 1 or a wash aid supply module 184 according to the embodiment of FIG. 3.
Figure 12:
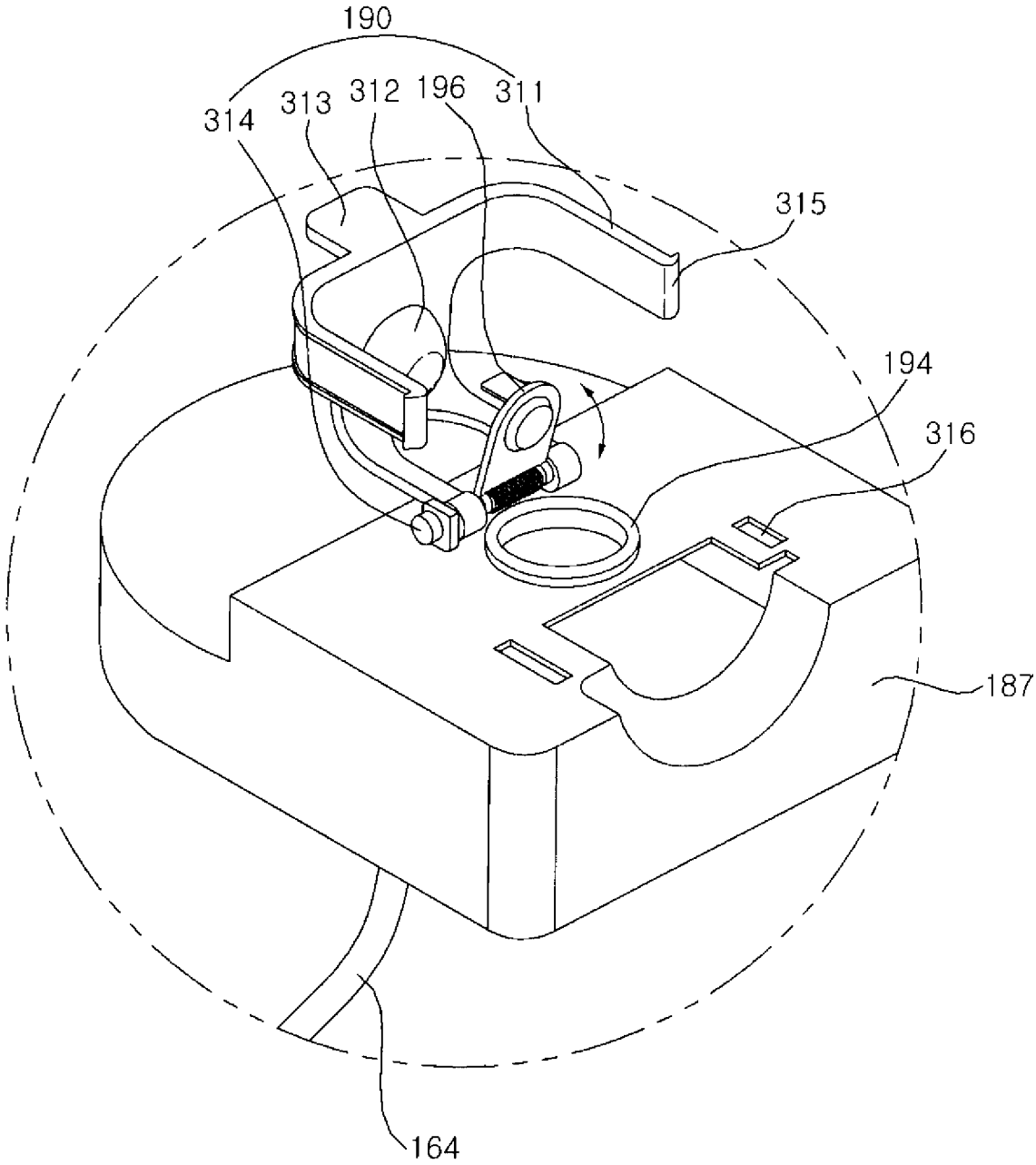
FIG. 12 is a perspective view of a container connecting unit in accordance with an embodiment of the invention.
Figure 13:
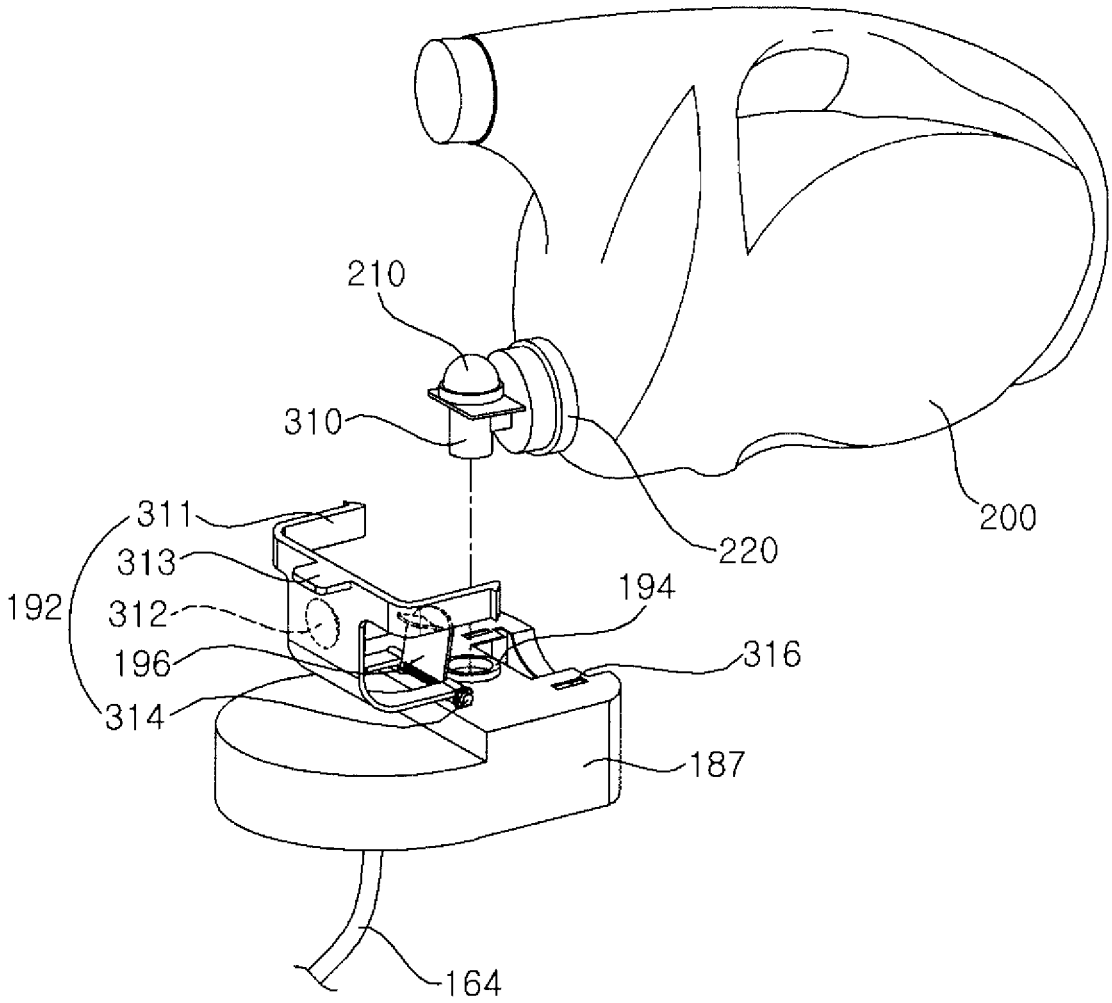
FIG. 13 is a perspective view showing alignment of a liquid wash aid container with a reservoir, which includes a container connecting unit, all in accordance with an embodiment of the invention.
Figure 14:
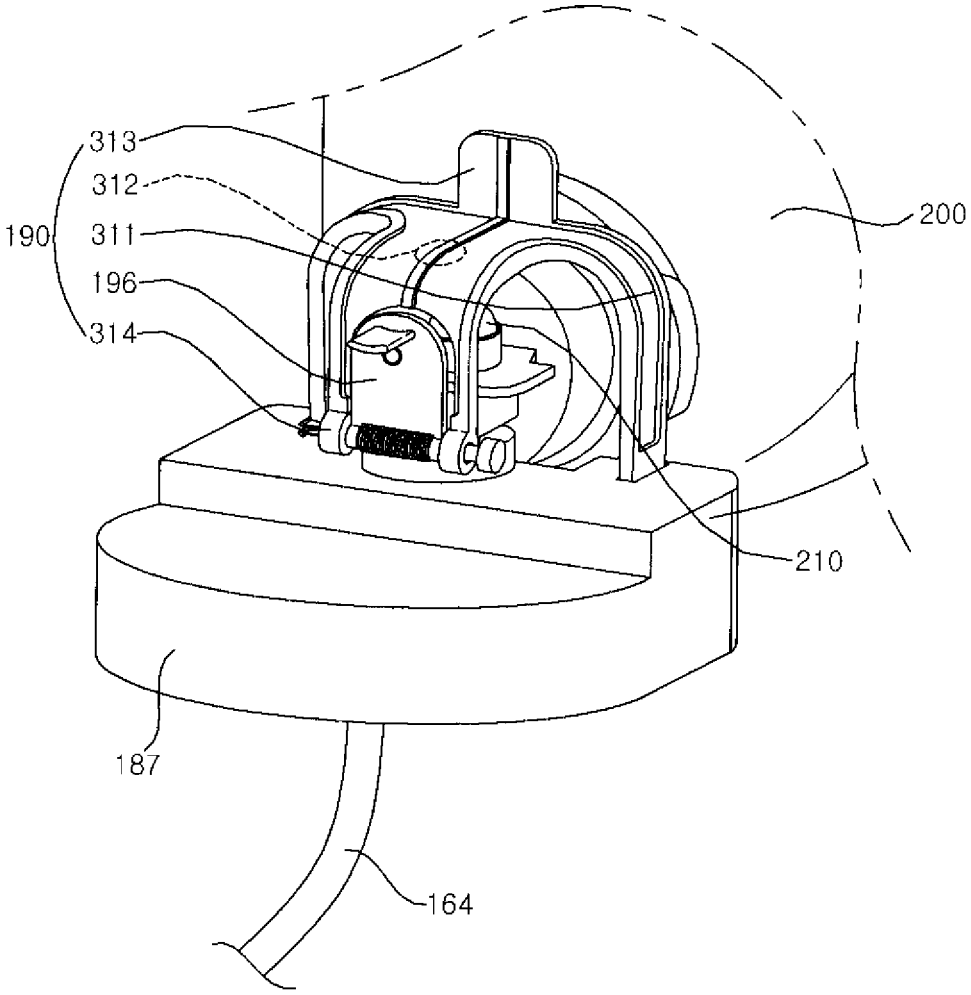
FIG. 14 is a perspective view showing a liquid wash aid container coupled to a reservoir, where a container connecting unit is in a secured position over the spout assembly of the wash aid container, all in accordance with an embodiment of the invention.

The container connecting assembly 192 and its coupling to the wash aid container 200 will now be described with reference to FIGS. 10-14. FIG. 10 is a perspective view of a portion of an upper surface of a washing machine according to the embodiment of FIG. 1 or a wash aid supply module 184 according to the embodiment of FIG. 3. FIG. 11 is a perspective view of a reservoir 186 coupled to a liquid wash aid supply container 200 in accordance with the embodiments of either FIG. 1 or FIG. 3. In FIG. 11, the reservoir 186 is threaded onto a reservoir receiving portion 178. The reservoir receiving portion 178 may be connected via screws (not shown) through flanges 190 into the underside of the top of the washing machine 100 or the wash aid supply module 184. FIG. 12 is a perspective view of a container connecting assembly 192 in accordance with an embodiment of the invention. FIG. 13 is a perspective view showing alignment of a liquid wash aid container 200 and a reservoir 187. In the embodiments of FIGS. 12 through 13, the reservoir 187 is combined with a container connecting assembly 192. FIG. 14 is a perspective view showing a liquid wash aid container 200 coupled to a reservoir 167, where a container connecting assembly 192 is secured to the spout assembly of the wash aid container 200.

In each of the embodiments disclosed, a container connecting assembly 192 may be implemented to mechanically couple the wash aid container 200 to the reservoir 186, 187. The container connecting assembly 192 includes a spout fixing unit 311 configured to fix a spout 310 (FIG. 13) of the wash aid container 200 to a spout inlet 194, a button depressing unit 312 configured to push down a mechanically operated valve 210 of the wash aid container 200, a handle 313 configured to allow a user to rotate the spout fixing unit 311 by hand, and a rotary connection unit 314 configured to rotatably connect the spout fixing unit 311 and the reservoir 186, 187 so that the spout fixing unit 311 can be rotated about the connection unit 314 and capture a portion of the container 200.

The spout fixing unit 311 fixes the spout 310 of the wash aid container 200 to the reservoir 186, 187 and may be formed in various shapes according to the shape of the spout assembly of the wash aid container 200. In the embodiments of the present invention, the spout fixing unit 311 has a squared "C" or "U" shape, which is open at one side and closed on the remaining three sides. In the embodiments illustrated, the open portion of the spout fixing unit 311 receives the spout assembly of the wash aid container 200. Wedge shaped protrusions 315 at the ends of the spout fixing unit 311 may snap into corresponding slots 316 on the top of the washing machine 100, the top of the wash aid supply module 184, or the top of the reservoir 187, thereby releasably securing the spout assembly of the wash aid container 200 within the spout fixing unit 311.

The button depressing unit 312 may be provided to depress the mechanically operated valve 210 when fixing the wash aid container 200 to the reservoir 186, 187. The button depressing unit 312 may be formed in various shapes according to the position and shape of the mechanically operated valve 210. The button depressing unit 312 may formed in a dome shape that protrudes from the bottom of the spout fixing unit 311.

The handle 313 may be provided to allow the user to rotate the spout fixing unit 311 of the container connecting assembly 192. In the embodiments illustrated herein, the handle 313 and has a flat shape formed in a direction perpendicular to the spout fixing unit 311.

The rotary connection unit 314 rotatably connects spout fixing unit 311 of the container connecting assembly 192 to an upper surface of the washing machine 100, an upper surface of the wash aid supply module 184, or an upper surface of a reservoir 187. The spout fixing unit 311 rotates about the axis of the rotary connection unit 314, thus allowing the spout assembly of the wash aid container 200 to be secured therebetween.

The container connecting assembly 192 may further include a cover unit 196 configured to open and close or otherwise uncover or cover the liquid wash aid spout inlet 194. The cover unit 196 may be provided to cover the liquid wash aid inlet 194 in case no wash aid container 200 is seated on the top surface of the washing machine 100, the top surface of the wash aid supply module 184, or the top surface of the reservoir 187. As in the embodiments illustrated, the cover unit 196 may be part of the assembly of the container connecting assembly 192. The rotary connection unit 314 may act as a hinge pin, passing through a cooperating receiving portion of the cover unit 196 substantially as shown in the exemplary illustrations of FIGS. 10 through 14.

Preferably, the container connecting assembly 192 provides identification marks in accordance with the kinds of liquid wash aid containers 200 coupled thereto. For example, the container connecting assembly 192 may provide different colors in accordance with the kinds of the liquid wash aid containers including a washing detergent wash aid container, a cleaning detergent wash aid (e.g., fabric softener) container, a bleaching liquid wash aid container, etc. Otherwise, it is possible to display characters indicating the kinds of the liquid wash aid containers connected to the container connecting assembly 192. Moreover, it is possible to display colors and/or characters on the respective portions where the liquid wash aid containers are seated in the wash aid supply module 184.

The above-described structure of the container connecting assembly 192 may be modified in various ways according to the shape of the wash aid container 200 by those skilled in the art.

The top surface of the washing machine 100, the top surface of the wash aid supply module 184, and the top surface of the reservoir 187, in accordance with the various embodiments of the present invention, may include a spout inlet 194, into which the spout 310 of the liquid wash aid container 200 is fixed and through which the liquid wash aid drawn from the wash aid container 200 is introduced into the reservoir 186, 187. As will be understood, a resilient temporary or permanent seal, such as an O-ring or a flat circular washer, may be provided between the spout 310 (or spout assembly) and the spout inlet 194 in order to provide a leak-proof or leak-resistant seal therebetween.

In the embodiments of FIGS. 1 and 3, a plurality of liquid wash aid spout inlets 194 may be provided to correspond to the number of liquid wash aid containers 200 and reservoirs 186. In the embodiments illustrated, three liquid wash aid spout inlets 194 are provided. Suitably, the liquid wash aid introduced into the liquid wash aid spout inlet 194 is stored in a corresponding reservoir 186, 187.

The washing machine 100, 102 in accordance with various embodiments of the present invention may include a concentration selection unit 189 configured to select/indicate the concentration of the liquid wash aid stored in the wash aid container 200.

The concentration selection unit 189 may allow a user to select the concentration of liquid wash aid according to the kind of liquid wash aid. In the case where the liquid wash aid is double-concentrated, the concentration selection unit 189 may be set to select a "double" as the concentration. Then, the wash aid control unit 168, under the control of the processor 105, controls the amount of liquid wash aid supplied to the washing tub 120 according to the concentration selected by the concentration selection unit 189. Similarly, the washing machine 100, 102, 103, in accordance with the various embodiments of the invention, may include a concentration selector 182 on the control panel 116 of the washing machine 100, 102, 103. The concentration selection unit 189 and/or the concentration selector 182 may interface to the processor 105.

Figure 15:
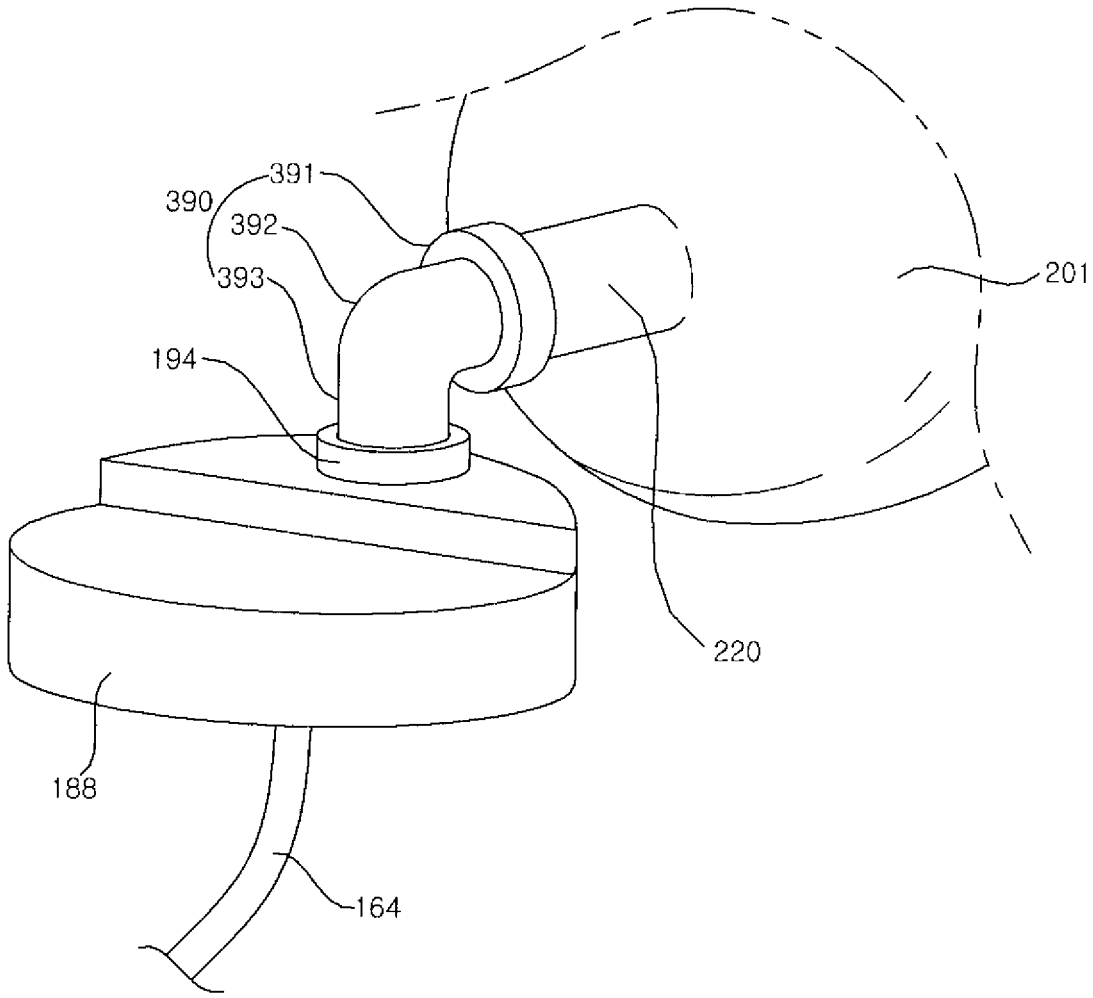
FIG. 15 is a perspective view showing an alternate embodiment of a liquid wash aid container coupled to a liquid reservoir in accordance with another embodiment of the invention.

FIG. 15 is a perspective view showing an alternate embodiment of a liquid wash aid container 201 coupled to a wash aid reservoir 188 in accordance with another embodiment of the invention. As illustrated in FIG. 15, a wash aid container coupling unit 392 may be configured to couple a generic wash aid container 201 to a wash aid reservoir 188 (similar to 186 and 187), even though the spouts of generic wash aid containers vary in shape.

A wash aid container coupling unit 390 includes a spout coupling part 391 adapted to couple to a spout 220 of a generic wash aid container 201, a guiding part 392 adapted to guide wash aid discharged from the spout 220, and an inlet coupling part 393 adapted to couple the guiding part 392 to a wash aid spout inlet 194 of a reservoir 188.

The spout coupling part 391 may be embodied to vary in its shape so as to correspond to the shape of a variety of spouts of generic wash aid containers. The method for implementing the spout coupling part 391, such that its shape can vary, may be implemented by an ordinary person in the art to which the present invention pertains. For example, the spout coupling part 391 may be implemented by using an elastic material so as to be inserted into or around container spouts that may have various shapes and sizes.

Figure 16:
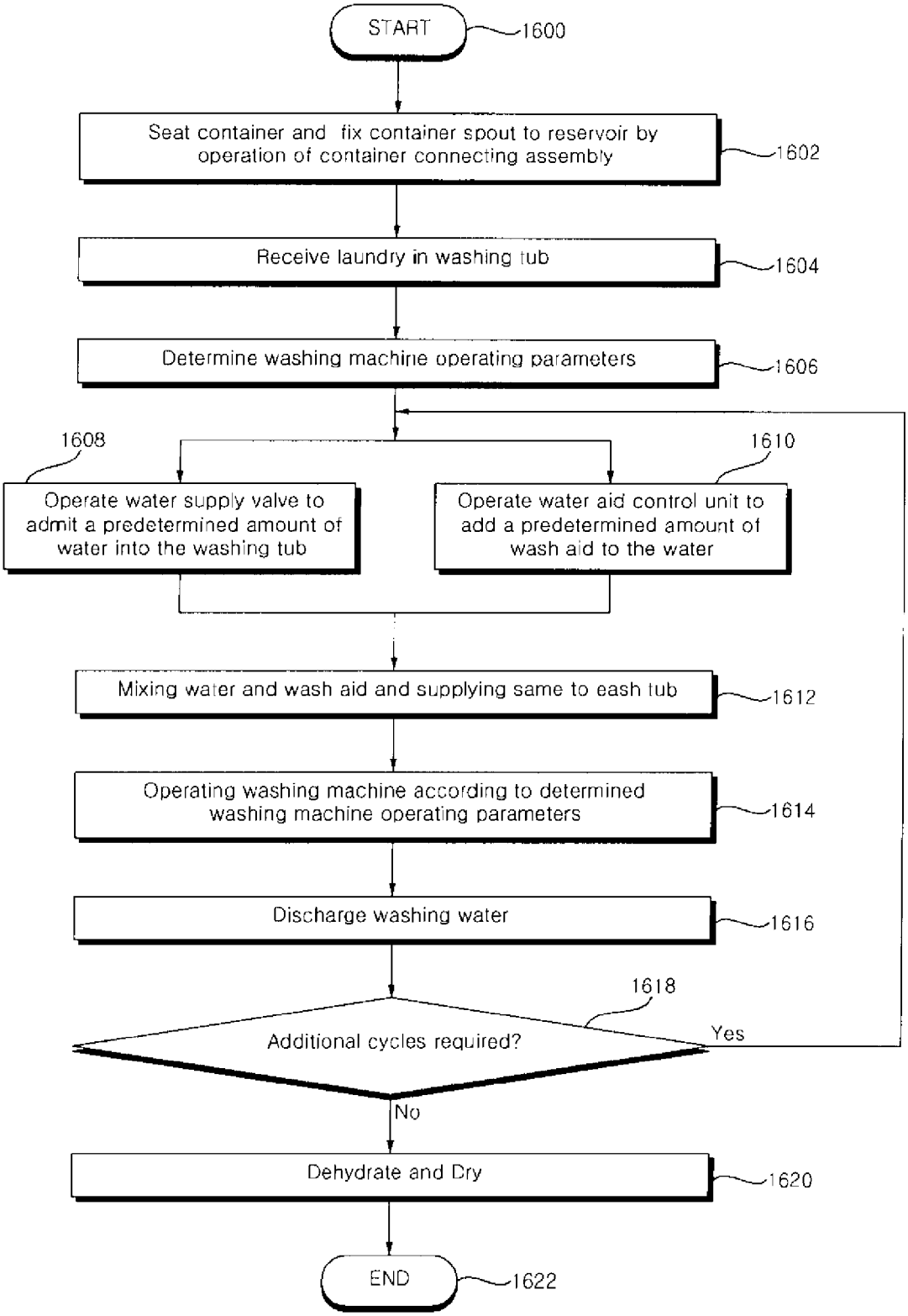
FIG. 16 is a flow diagram of a method of use of a washing machine in accordance with an embodiment of the invention.

FIG. 16 is a flow diagram of a method of use of a washing machine in accordance with an embodiment of the invention. The operation of the above-described washing machine 100, 102, 103 in accordance with embodiments of the present invention and a washing method in accordance with another embodiment of the present invention will be described below with reference to FIG. 16.

At 1600, the method may start. At 1602, the wash aid container 200 may be seated on the top surface of the washing machine 100 according to the embodiment of FIG. 1, on the top surface of the wash aid supply module 184 according to the embodiment of FIG. 3, or on any surface according to the embodiment of FIG. 7. The container connecting assembly 192 fixes the wash aid container 200 and, when the mechanically operated valve 210 is depressed, the liquid wash aid in the wash aid container 200 is supplied to the reservoir 186, 187. The supplied liquid wash aid is temporarily stored in the reservoir 186, 187.

At 1604, the door 112 is opened and laundry is put into the tub 124 of the washing tub 120. At 1606, when the washing machine 100, 102, 103 is operated after closing the door 112, the amount of laundry put into the tub 124 may be detected, and the water level, the amount of liquid wash aid to be supplied, the washing time, etc. are determined by operation of the processor 105.

At 1608, as the water supply valve 131 is opened, a predetermined amount of wash water is supplied from an external water source. At 1610, the wash aid control unit 168 is operated according to commands executed by the processor 105, a predetermined amount of the liquid wash aid stored in the reservoir 186, 187 is supplied to the wash water. In the case where a plurality of reservoirs 186, 187 are provided, a washing liquid wash aid (e.g., laundry detergent) is supplied at this time. In one embodiment, the liquid wash aid stored in the reservoir 186 is introduced into the mixing unit 133 through the flexible conduit 164. In another embodiment, the liquid wash aid stored in the reservoir 187 is introduced into the wash aid box 114 through the flexible conduit 164. Variations of these combinations are within the scope of the invention.

At 1612, the wash water and liquid wash aid are mixed in the mixing unit 133 and/or the wash aid box 114, and introduced into the tub 124 and drum 122 of the washing tub 120 via the second water supply passage 134.

At 1614, after the wash water and liquid wash aid are supplied to the washing tub 120, the driving unit 113 operates to rotate/agitate the laundry in the tub 124 for a predetermined time in accordance with the determined washing machine parameters. At this time, the wash water and liquid wash aid may be circulated in and out of the washing tub 120 by the circulation pump 136.

At 1616, upon completion of the above-described washing cycle, the operation of the driving unit 113 is stopped, and the discharge pump 142 operates to discharge the wash water and liquid wash aid used during the washing cycle to the outside.

At 1618, if an additional cycle of supplying water and/or wash aid is needed, the method returns to 1608 and/or 1610, respectively, whereupon the water supply valve 131 is opened to supply wash water from the external water source, and the wash aid control unit 168 operates to supply a predetermined amount of a cleaning liquid wash aid (e.g., fabric softener).

If the method returns to 1608 and 1610, then at 1612 the wash water and liquid wash aid are mixed as described above and introduced into the washing tub 120 via the second water supply passage 134.

At 1614, after the wash water and liquid wash aid are supplied to the washing tub 120, the driving unit 113 operates to rotate the tub 124 for a predetermined time according to determined the washing machine operating parameters, thus performing a rinsing cycle. At this time, the wash water and liquid wash aid may be circulated in and out of the washing tub 120 by the circulation pump 136.

At 1616, upon completion of the above-described rinsing cycle, the operation of the driving unit 113 is stopped, and the discharge pump 142 operates to discharge the wash water and liquid wash aid to the outside.

At 1618, if another cycle of supplying water and/or wash aid is not needed, the method continues to 1620, where, a dehydrating cycle and a drying cycle may be performed according to a predetermined schedule as determined by the washing machine operating parameters.

At 1622, the method may end.

During the above process, a user may observe if the amount of liquid wash aid stored in the reservoir 186, 187 is insufficient to perform the washing cycle. The user need only observe the viewing port 186*a* associated with the reservoir 186. If the amount is nearly insufficient or is insufficient, the user may replace the empty wash aid container 200 with a full container.

Although the washing machine according to the present invention has been described with reference to the illustrated drawings, it will be apparent to those skilled in the art that the present invention is not intended to be limited to the above-described embodiments and drawings, and various changes or modifications may be made therein without departing from the scope and the technical sprit of the present invention.

That is, the present invention is not limited to a drum type washing machine, but can be applied to a water jet washing machine in which liquid wash aid may be used. Moreover, the present invention may be applied to various washing machines such as a dishwasher in which liquid wash aid may be used.

Figure 17:
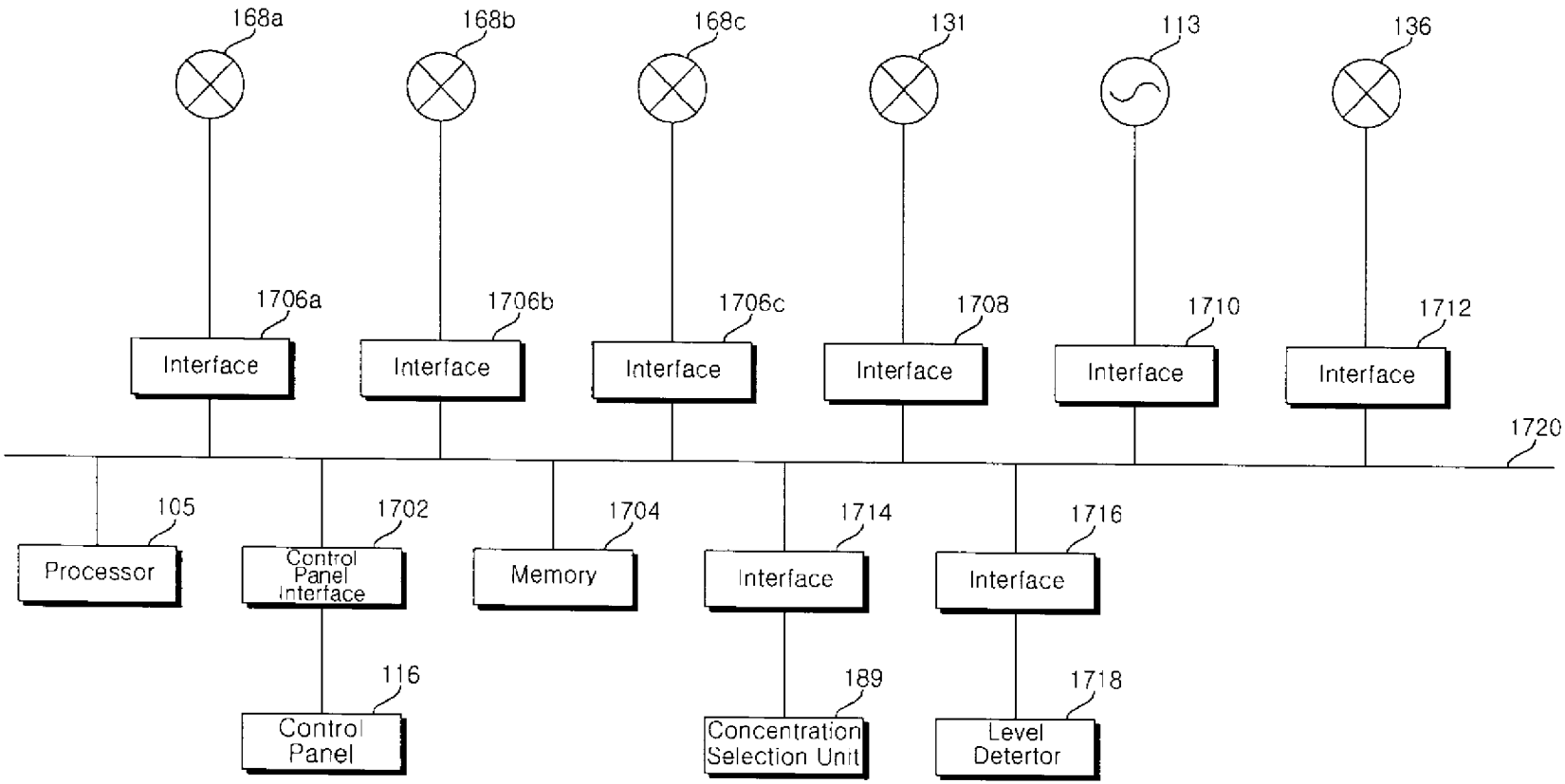
FIG. 17 is a schematic representation of a control system of a washing machine in accordance with an embodiment of the invention.

FIG. 17 is a schematic representation of a control system of a washing machine in accordance with an embodiment of the invention. A control system in accordance with an embodiment of the invention may include: a processor 105; a control panel interface 1702 coupled to a control panel 116 for both receiving input from a user and to display output to a user; a memory 1704 for storing instructions corresponding to a method of the invention, the instructions to be executed by the processor 105; one, or more than one, communication interfaces 1706*a*, 1706*b*, 1706*c* coupled to one or more wash aid controllers 168*a*, 168*b*, 168*c*; a communication interface 1708 coupled to a water supply valve 131; a communication interface 1710 coupled to a motor 113; a communication interface 1712 coupled to a circulation pump 136; a communication interface 1714 coupled to a concentration selection unit 189; a communication interface 1716 coupled to a concentration selection unit 189, and a communication interface coupled to a level detector 1718, all coupled to a communications bus 1720.

The washing machine and the washing method according to the present invention provide at least one of the following effects.

First of all, an appropriate amount of the liquid wash aid required for washing is automatically supplied.

Secondly, a commercially available liquid wash aid container containing liquid wash aid can be used as-is by connecting the same to the washing machine, and thus the user's convenience is improved.

Thirdly, the liquid wash aid container can be conveniently detached.

Finally, in the embodiment of FIG. 3, because the supply module 184, which receives and connects to the liquid wash aid containers is formed as a module, separate from the main body of the washing machine, it may be added subsequent to an original purchase of the washing machine 102, removed from the washing machine 102, and lifted/tilted above the top of the washing machine 102 to allow for service of components on its underside.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A system, comprising:

an enclosure;

a drum housed within the enclosure;

a mixing unit, housed within the enclosure, separate from the drum, and in fluid communication with the drum;

a water supply unit coupled to the mixing unit;

a reservoir having a conduit configured to fluidly couple the reservoir to the mixing unit;

a supply module provided on a top surface of the enclosure, receiving a container on a top surface thereof, and having a spout inlet to receive a spout of the container;

a hinge assembly configured to couple the supply module to the enclosure so that the supply module can be tilted with respect to the top surface of the enclosure;

a support unit rotatably coupled to an underside of the supply module and configured to support the supply module in the tilted state;

a container connecting assembly provided on the top surface of the supply module near the spout inlet and configured to fix the spout of a container to the spout inlet; and a reservoir receiving portion, connected to the underside of the supply module corresponding to the spout inlet, having a threaded exterior portion, wherein the reservoir has a threaded interior portion which mates with the threaded exterior portion of the reservoir receiving portion so that the reservoir is removably connected to the reservoir receiving portion.

2. The system of claim 1, wherein the mixing unit is a removable or a non-removable wash aid box.

3. The system of claim 1, wherein the reservoir is external to the enclosure.

4. The system of claim 1, wherein the container connecting assembly is further configured to maintain a valve of the container in an open position, to permit an unimpeded flow of the container's contents into the reservoir, when the spout of the container is fixed to the reservoir.

5. The system of claim 1, further comprising a pump configured to transfer a metered volume of liquid from the reservoir to the mixing unit.

6. The system of claim 1, wherein a top surface of the supply module is configured to:

receive the container in an integrally formed recess, and maintain the container at an altitude such that gravity will cause the container's liquid contents to flow out of the container's spout, to make the container empty of or near empty of its liquid contents.

7. The system of claim 1, further comprising:

a water supply valve through which wash water may be introduced from an external water source connecting to the mixing unit; and a wash aid box slidingly engaged within the enclosure connected to the mixing unit by a first water supply passage.

8. The system of claim 1, wherein the reservoir is partially or entirely transparent, to permit observation of a level of the reservoir's contents.

9. The system of claim 1, further comprising a concentration selection unit provided to select the concentration of a liquid contained in the container.

* * * * *